US008533981B2

(12) United States Patent
White

(10) Patent No.: US 8,533,981 B2
(45) Date of Patent: Sep. 17, 2013

(54) METHOD TO ATTEND IN THE DISTANT FUTURE A PRESCHEDULED APPOINTMENT

(76) Inventor: William L White, Phoenix, AZ (US)

( * ) Notice: Subject to any disclaimer, the term of this patent is extended or adjusted under 35 U.S.C. 154(b) by 0 days.

(21) Appl. No.: 13/373,028

(22) Filed: Nov. 2, 2011

(65) Prior Publication Data

US 2012/0285053 A1 Nov. 15, 2012

Related U.S. Application Data

(60) Provisional application No. 61/518,636, filed on May 9, 2011.

(51) Int. Cl.
*G09D 3/04* (2006.01)

(52) U.S. Cl.
USPC ..... 40/121

(58) Field of Classification Search
USPC ..... 40/107, 121, 122, 654.01, 657, 771; 283/2, 3
See application file for complete search history.

(56) References Cited

U.S. PATENT DOCUMENTS

| | | | | |
|---|---|---|---|---|
| 811,846 | A * | 2/1906 | Hidden | 40/118 |
| 4,896,027 | A * | 1/1990 | Drexler | 235/488 |
| 5,257,940 | A * | 11/1993 | Schaarschmidt | 434/304 |
| 7,293,379 | B2 * | 11/2007 | Paulos | 40/107 |

* cited by examiner

*Primary Examiner* — Joanne Silbermann
(74) *Attorney, Agent, or Firm* — Tod R. Nissle, P.C.

(57) ABSTRACT

A method to remind an individual of an appointment scheduled in advance for the distant future requires that an oversized calendar be provided with a plurality of overlain separable discardable sheets each depicting a month of the year, that the calendar be mounted on a vertically oriented surface in a high traffic area, that during a current month an appointment be scheduled in advance for a date in a month in the distant future, that a sleeve be manually mounted in the calendar on the date in the distant future, that information concerning the appointment be manually integrated in the sleeve, that at least one of the separable discardable sheets be removed to expose the month in the distant future, and that the information concerning the appointment be viewed.

1 Claim, 5 Drawing Sheets

METHOD TO ATTEND IN THE DISTANT FUTURE A PRESCHEDULED APPOINTMENT

This application claims priority based on U.S. Provisional Patent Application Ser. No. 61/518,636 filed May 9, 2011.

This invention relates to attendance.

More particularly, the invention relates to methods and apparatus for insuring that an individual attends a prescheduled appointment, particularly an appointment scheduled in the distant future.

In present day United States, many distracting and sometimes discouraging conditions exist. An unusually high number of people are unemployed. Unemployment is not projected to improve for three or more years. Students graduate from college mired in debt due to student loans, and can not find employment. Inflation is on the rise. The cost of healthcare is rising; the cost of education more so. The incidence of some diseases appears on the increase, and there is an overarching concern that there will be an epidemic or pandemic of bird flu or some other disease. People often seem less organized, and more distracted. Many are unhappy, even fearful.

Such distractions have in many cases caused individuals to forget or miss scheduled appointments. At first blush, missing an appointment seems to be a rather minor issue compared with many other present day issues which appear more pressing and important. The problem, however, is that missing an appointment often can have a significant detrimental effect on an individual and the individual's family. And, in many cases appointments are scheduled weeks or months in the future and are more susceptible to being forgotten or being inaccurately recollected.

A student was granted a scholarship worth thousands of dollars and had only to appear at the appointed time to sign papers. He missed the appointment. He lost the scholarship.

A man missed his appointment with a cardiologist. The appointment was reset for a date several weeks in the future. The man had a heart attack the next day and died.

A women was scheduled to attend a concert to meet an individual that was prepared to offer her a job. The woman missed the conference and lost the job.

A man missed a doctor's appointment at which he was to receive a prescription for needed medication. The man's pharmacist gave the man a generic substitute. The man had an adverse reaction to the substitute medication and ended up in the hospital.

A seller was selling a car at a significantly marked down price. The buyer had to appear at a designated time to sign papers and pay the seller. The buyer missed the appointment. The seller sold the car to another party.

A man missed a conference at which he would learn how to fill out a lengthy government application. The man filled out the government application "on the fly" and made critical mistakes. The application had to be redone and resubmitted.

A man was purchasing a competition horse for tens of thousands of dollars. He missed his appointment and lost the horse.

A couple missed an appointment to adopt a child and lost the child.

A man unemployed for many months was offered a job and had only to appear at the appointed time to fill out paperwork necessary to begin the job. He missed the appointment and lost the job.

A woman missed a court date. The judge entered a costly default judgment against the woman.

And so on.

In each of the above cases the pertinent appointment was made over a week, typically over two weeks in advance; and, there were no unusual factors that caused the individuals to miss the appointment. Each individual simply "got busy" and forgot the correct date and/or time of the appointment. And, many, if not each, of the individuals had day timers or had appointment records on their cell phone or portable computer or elsewhere.

Accordingly, it would be highly desirable to provide an improved method and apparatus to increase the likelihood that an individual will attend timely an appointment scheduled in the distant future.

Therefore, it is a principal object of the instant invention to provide an improved method and apparatus to insure that an individual will likely attend a future appointment.

This and further and more specific objects and advantages of the invention will be apparent to those skilled in the art from the following detailed description thereof, taken in conjunction with the drawings, in which.

Briefly, in accordance with the invention, provided is an improved method to remind an individual of an event scheduled in advance for the distant future, comprising the step of providing a calendar including a plurality of discardable removable pliable sheets overlain in registration with each other. Each of the plurality of sheets includes at least one imprinted sequential month and the days thereof. The plurality of sheets collectively includes sequential months and the days thereof extending over a period of time comprising at least one year. Each of the plurality of sheets includes a plurality of sequential defined areas each designating one day of a month and having a width of at least three inches. The first one of the sheets displays the current month, and a second one of the sheets located behind the first one of the sheets displays a future month. The method also includes the steps of providing a plurality of sleeves each having a width no greater than the width of each of the sequential defined areas; providing a plurality of attachment structures for securing each of the sleeves to a different one of the sequential defined areas; vertically mounting the calendar at eye level in a increased awareness location in an individual's residence. The increased awareness location is in a high traffic area utilized by the individual at least twice a day; and, comprises a vertically oriented mounting surface. The method also includes the steps of scheduling in advance during the current month an appointment in the distant future on an appointment day in the future month; mounting, with one of the attachment structures, one of the sleeves to one of the defined areas in the calendar corresponding to the appointment day in the future month; integrating in the one of the sleeves printed information about the appointment; walking by the calendar at least twice a day in the residence; periodically removing from the calendar and discarding ones of the sheets which include months preceding the future month and which do not include the future month until the one of the sheets including the future month is visible; and, the one of the sleeves mounted in the one of the defined areas corresponding to the appointment day is visible. The method also includes, once the one of the sheets including the future month is visible, the step of viewing the printed information integrated into the one of the sleeves mounted in the one of the defined areas corresponding to the appointment day.

Figure 1:
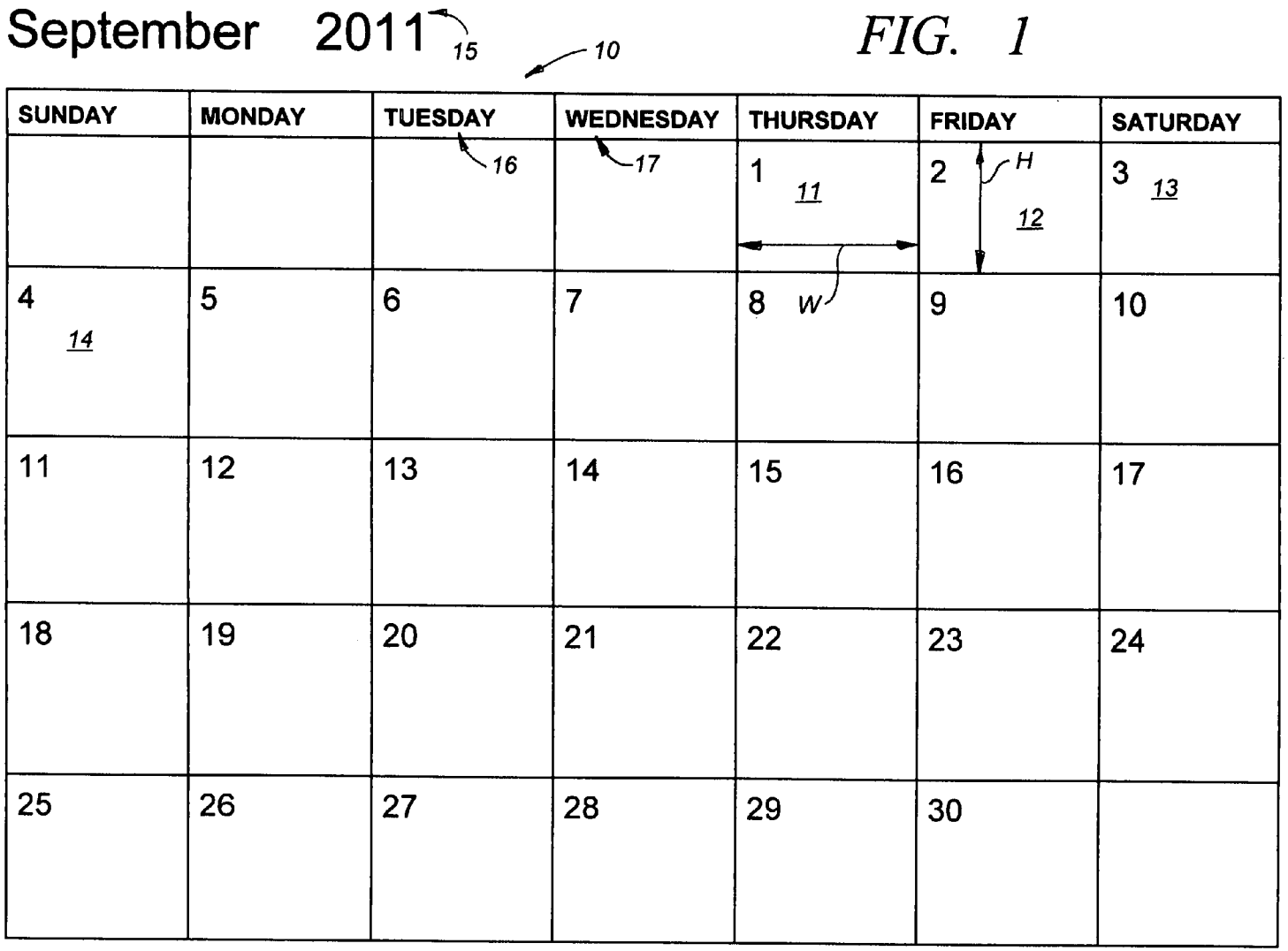
FIG. 1 is a front view illustrating an imprinted sheet in a calendar produced in accordance with the invention.

Turning now to the drawings, which depict the presently preferred embodiments of the invention for the purpose of illustrating the practice thereof and not by way of limitation of the scope of the invention and in which like reference characters refer to corresponding elements throughout the several views, FIG. 1 illustrates a removable discardable pliable sheet 10 in a calendar constructed in accordance with the invention and generally indicated by reference character 10. Sheet 10 includes imprinted sequential month designation September 2011 15 and includes the days 1, 2, 3, 4 . . . 30 in the month of September. Sheet 10 also includes a plurality of sequential defined areas 11, 12, 13 each designating a day of the month. Each area 11, 12, 13 has a width, W, of at least three inches, preferably at least four inches, more preferably at least five inches, and most preferably at least six inches. The height, H, at least two inches, preferably at least three inches, more preferably at least four inches, and most preferably at least five inches. The use of a large sized designated area 11 to 13 was, during the development of the invention, found important because it produces an oversized calendar and facilitates insuring that an individual will consciously or subconsciously view and take notice of the calendar. A regular size calendar utilizing smaller sized areas 11, 12, 13 is often much less likely to consciously or subconsciously register in the mind of an individual. Such regular sized calendars are not utilized in the practice of the invention.

Figure 5:
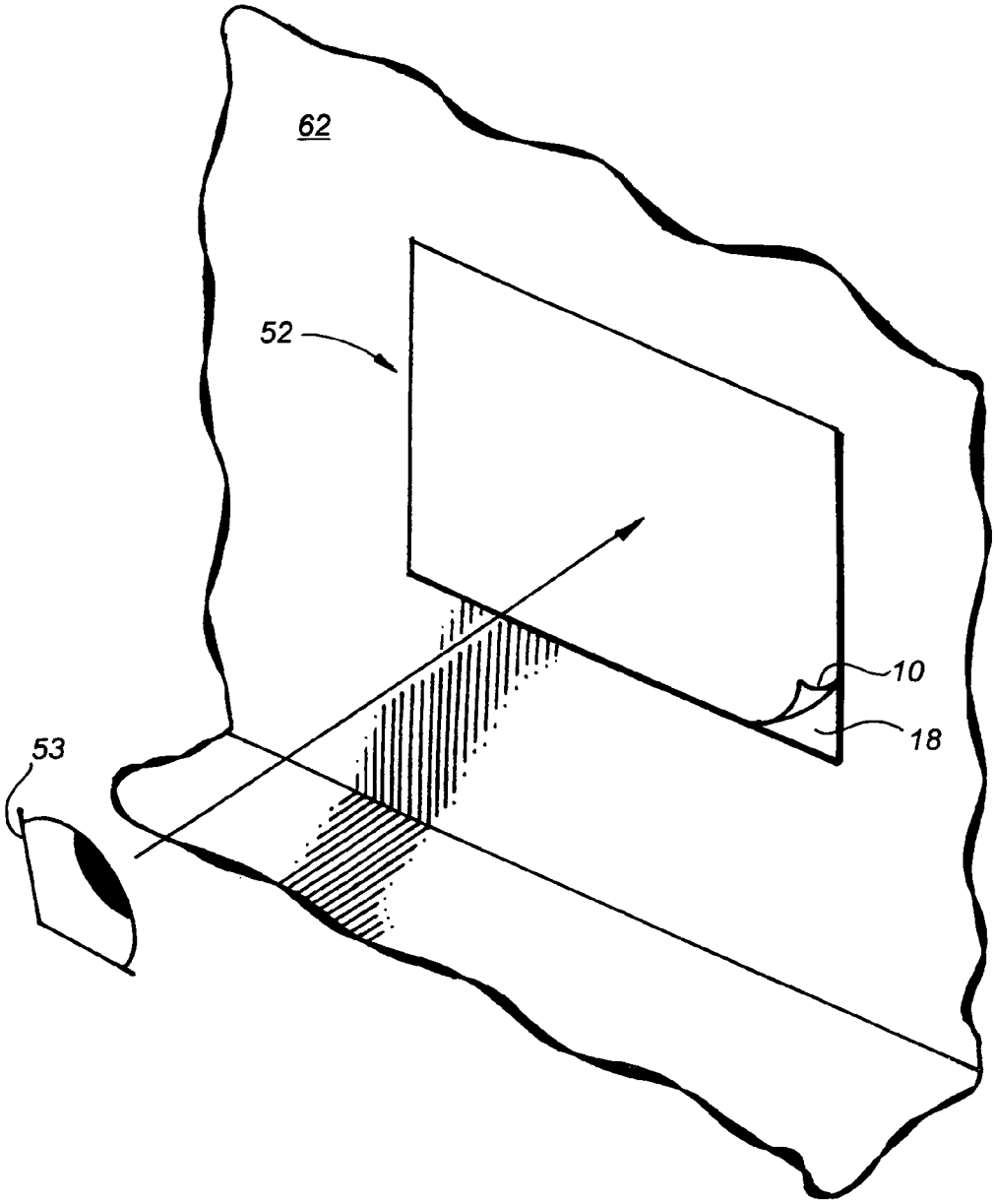

It was also discovered during development of the invention that a calendar which requires sheets to be periodically manually removed from the calendar during a year is important because if all the months during a period of one year are shown in a single sheet of paper, it is more likely that an individual will begin to walk by and not take notice of the calendar. Requiring the periodic removal of sheets from the calendar forces an individual to focus on and physically engage the calendar, making it significantly more likely the individual will consciously pay attention to the calendar. Each removable sheet includes at least seven days in a calendar month, preferably at least fourteen days in a month, more preferably at least twenty-one days in a month, and most preferably all of the days in a calendar month. Each removable sheet can include more than one month, but a calendar 50, 51, 52 must include at least two sheets, one removable, for a year period. A calendar 50 to 52 that includes at least two sheets typically would include six months on each sheets. In the most preferred embodiment of the invention, however, each sheet 10 includes a single month of the year. For example, the calendar 52 in FIG. 5 includes sheet 10 for the month of September. After sheet 10 is torn off or otherwise removed, the month of October and the days in the month of October are imprinted on the next sequential sheet 18. When sheet 18 is torn off or otherwise removed, the month of November and the days in the month of November are imprinted on next sequential sheet 20 (FIG. 2), and so on. The months included in a calendar 50 to 52 can consist of any desired sequential series of months for any desired period of time. For example, one such sequential series of months could be from June 2011 to December 2011; or, could be from June 2011 to December 2012. Currently, however, the sequential series of months typically comprises from January through December of a given year.

While the material utilized to produce a pliable sheet 10 for a calendar 50 to 52 can vary as desired, paper is presently preferred for cost and weight reasons.

A calendar 50 to 52 is mounted using nails, hooks, Velcro Fastener™, or any other desired fastening system. The calendar 50 to 52 is mounted in a high traffic area in a residence on a wall or other vertically oriented surface. Further, the calendar 50 to 52 needs to be mounted so that at least a portion of the calendar is, when an individual is standing, at eye level 53 in the manner illustrated in FIG. 5. Laying the calendar 50 to 52 on a horizontal surface is not acceptable in the practice of the invention. Placing the calendar 50 to 52 in an area that is not a high traffic area is not acceptable in the practice of the invention. A high traffic area in a residence is an area where an individual will walk through and view a calendar 50 to 52 on a wall at least twice daily, preferably at least five times daily, more preferably at least ten times daily, and most preferably at least twenty times daily. Further, the individual preferably will view the calendar 50 to 52 because the individual must, when traversing the high traffic area, walk toward the wall or other vertical surface on which the calendar is mounted in a vertical orientation. Most preferably, when the individual walks toward the wall the calendar will be directly in front of the individual and the individual must walk directly toward the calendar while traversing the high traffic area. For example, if the calendar is on a wall at the end of a hall, and an individual must walk down the hall directly toward the wall to get to his room through a doorway on the right hand side of the hallway, then the individual must walk directly toward the calendar. Similarly, if in FIG. 4 an individual is walking in the direction of arrow D to arrive at doorway 63, the individual is walking directly toward wall 62 and toward a calendar 52 mounted on wall 62. In contrast, if in FIG. 4 an individual is walking toward door 64 in the direction of arrow E, the individual walking toward wall 61 and likely will see calendar 51 on wall 61 but is not walking directly toward calendar 51. Calendar 51 is located laterally from the path of travel indicated by arrow E and is not directly in front of an individual moving along the path indicated by arrow E. Placing a calendar 51 on wall 61 is acceptable in accordance with the invention because calendar 51 is on a vertical surface and is at eye level; however, the location of calendar 52 is preferred over that of calendar 51 because it is more difficult for an individual to not view calendar 52. As utilized herein, the term residence includes homes and commercial buildings because many individuals spend more waking hours in or around a commercial building than in or around their home. A calendar 50 to 52 can be placed in a vertically oriented surface inside or outside of a residence.

Figure 2:
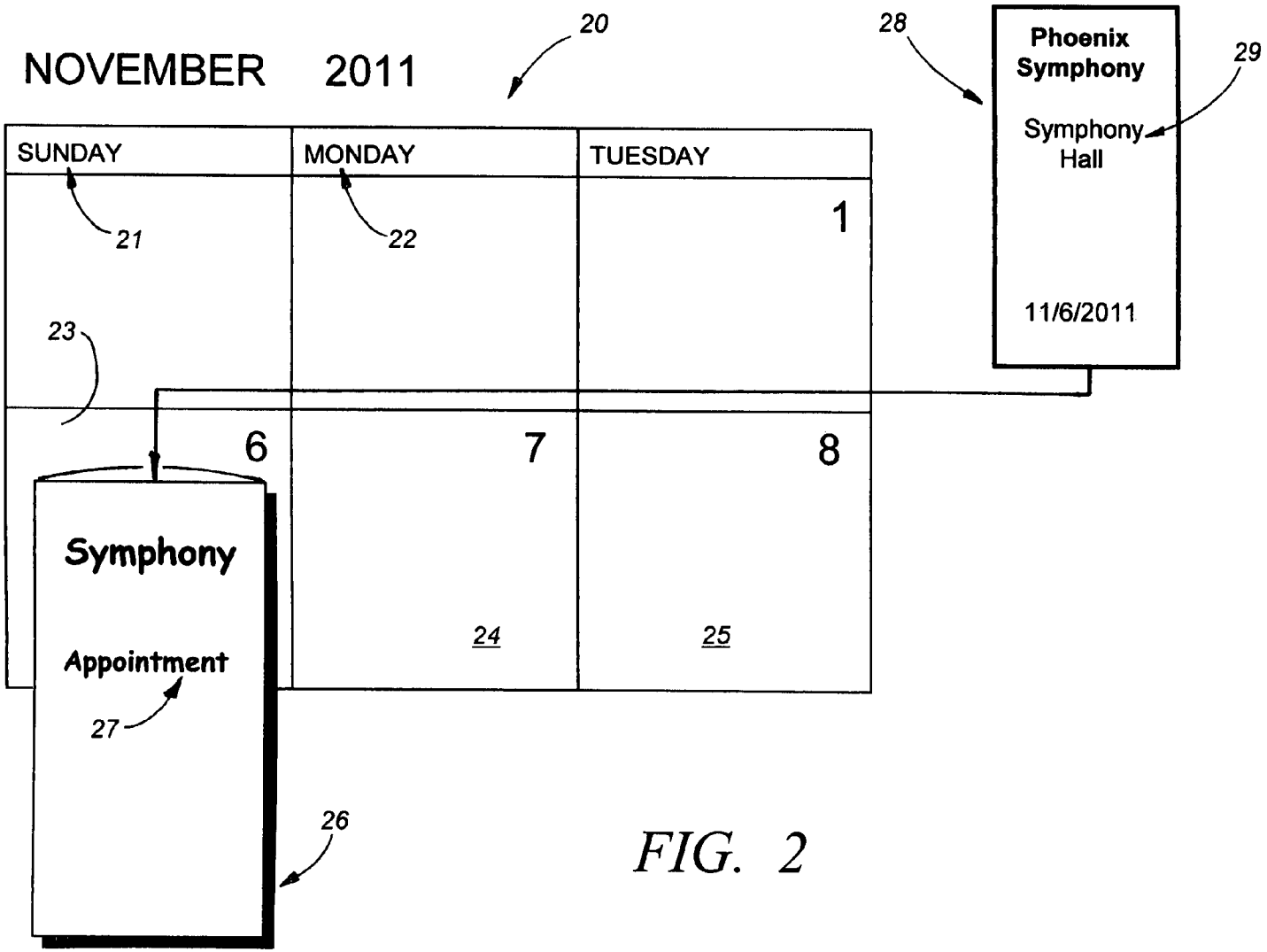
FIG. 2 is a front assembly view illustrating the mode of operation of an imprinted sheet in a calendar produced in accordance with the invention.
Figure 3:
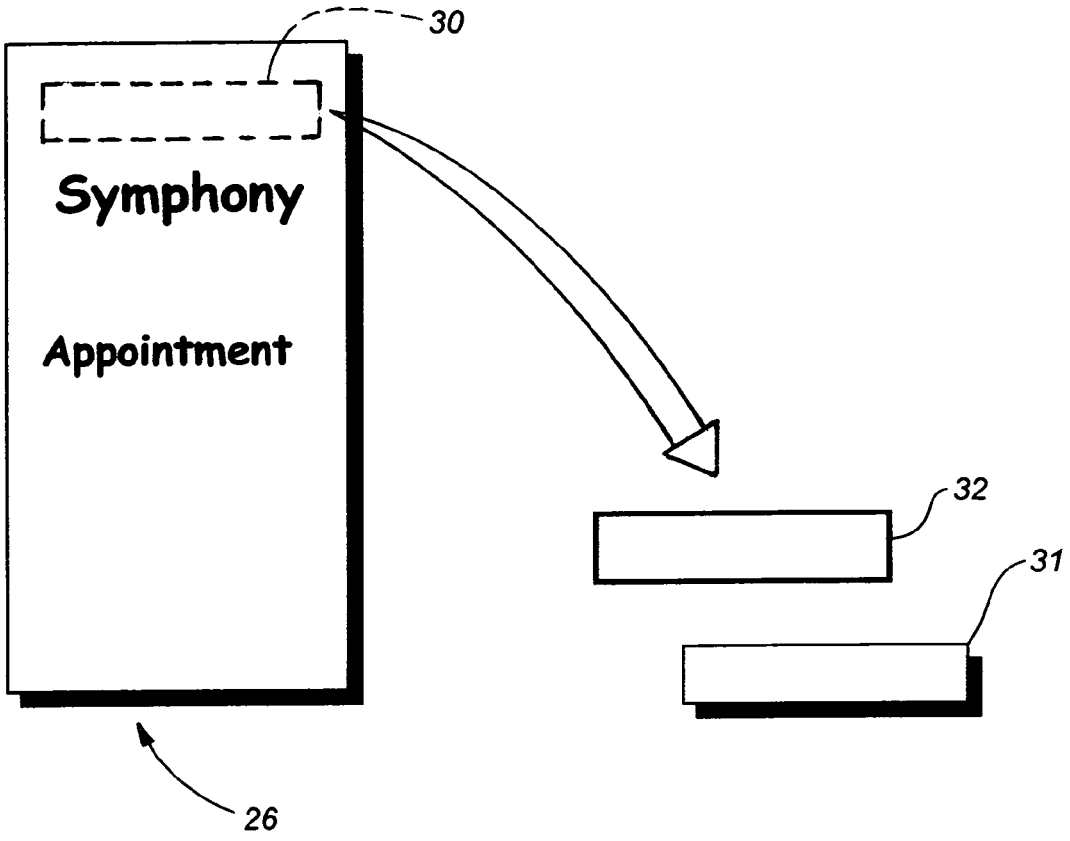
FIG. 3 is a front assembly view illustrating a sleeve constructed in accordance with the invention.

A calendar 50 to 52 is provided with a plurality of sleeves 26 (FIG. 2) which initially are not attached to calendar 50 to 52. Each sleeve 26 has a width that is no greater than the width of a designated area 11, 12, 13. A mounting system is provided to secure a sleeve 26 to a designated area 11 to 13 on a sheet 10, 18, 20 of a calendar 50, 51, 52. One such mounting system is illustrated in FIG. 3 and comprises a strip of contact adhesive 31 which is permanently secured to an area 30 on the back of sleeve 26. Adhesive strip 31 is covered by a removable protective strip 32 which can be peeled off strip 31. When it is desired to affix manually sleeve 26 to a designated area 23 in the manner illustrated in FIG. 2, protective strip 32 is manually peeled off adhesive strip 31 and strip 31 is manually pressed against sheet 20 in designated area 23 (or an adjacent designated area if appropriate) to secure at least the upper portion of sleeve 26 in area 23 at the location illustrated in FIG. 2. Identification information 27 is integrated with sleeve 26 by imprinting, writing, or otherwise forming the information on sleeve 26, or, if sleeve 26 includes a pocket, by inserting in the pocket a ticket or other material including information imprinted or otherwise formed on the ticket. The identification information 27 in FIG. 2 comprises the words "Symphony Appointment". Such identification information can, as noted, come pre-printed on a sleeve 26 or can be written or otherwise formed on sleeve 26 by the individual utilizing a calendar 50, 51, 52. Sleeve 26 can comprise a single solid unitary piece of material, or, as is presently preferred, can comprise a pocket which can receive slips of paper, tickets, or other information describing where an appointment takes places, when the appointment takes places, a description of what the appointment is (dentist, job interview, concert, etc.) and/or any other desired information. Sleeves 26 can be colored as desired or have eye catching designs or shapes formed on or as part of each sleeve 26. Since it is highly unusual for an individual to have a sleeve on each day of the month, one virtue of the invention is that when an individual views a sheet 10, 18, 20, the individual's attention is immediately drawn to the days on which sleeves 26 are attached and appointments are scheduled.

During development of the invention, it was discovered that it was important not to provide a calendar in which each day of a month already had a sleeve 26 preattached to the calendar. The physical act of attaching manually a sleeve 26 to a calendar on the day on which an appointment is scheduled functions to help ingrain the appointment date in an individual's mind because the individual's mind at least subconsciously retains a picture of the calendar and of the month and date at which sleeve 26 is attached to the calendar. Further, if a calendar is provided in which each day of a month already has a sleeve 26 preattached, each of the days looks similar and all of the days tend to fuse together in an individual's memory. If only a selected number of the days in a month includes sleeve 26 attached thereto, the days with sleeves 26 attached thereto tend to stand out and be better remembered.

During development of the invention, it was also discovered that it was important to have an individual manually physically integrate information in or on the sleeve 26 by, for example, writing on the sleeve or inserting in the sleeve a ticket or other piece of paper with appointment information inscribed on the piece of paper. The physical act of integrating imprinted information on the sleeve functions to help ingrain the appointment date in an individual's mind.

A particular virtue of the invention is that it is particularly useful in keeping track of events scheduled in the distant future. As used herein, distant future refers to an appointment which is one week (seven days) or more from the day on which an individual schedules the appointment. Further, one particular application of the invention pertains to appointments which are initially scheduled or arranged for in the month that presently visible on a calendar 50 to 52 for a date which is in a future month that is not currently visible on the calendar and which will become readily visible only after an individual removes from the calendar 50 to 52 the sheets that are covering and sequentially precede the future month. For example, if sheet 20 for the month of September 2011 is the face or cover sheet that is currently viewable on a calendar 50 to 52 and an individual makes an appointment for Nov. 6, 2011 (sheet 20 in FIG. 2), then sheet 20 and the month of November 2011 will be fully readily visible only after the preceding months of September and October have passed and sheets 10 and 18 have been torn off the calendar 50 to 52. Sheets 10 and 18 are, however, readily lifted (if for example the sheets in a calendar are attached along their top edge) to permit a sleeve 26 to be attached to the designated area 23 for the day of Nov. 6, 2011. During development of the invention, it was discovered that it is important for an individual to have to lift (in order to attach manually a sleeve 26 to the appropriate date in the calendar) manually sheets which include months or dates preceding the month in which the appoint is scheduled. This physical activity helps to reinforce the time of the upcoming appointment.

When an appointment is scheduled in advance and placed in memory in a cell phone, computer, or other electronic device, the appointment typically is out-of-sight and out-of-mind until it is viewed on the device on the date of the appointment. The method of the invention requires intermittent manual activity with respect to the calendar 50 to 52 utilized, and tends to provide ongoing reminders about upcoming appointments. Other disadvantages of hand-held electronic devices are that they lose power because batteries are not charged; they are be turned off; the device is on and operational but with the sound muted; data is inadvertently erased; the owner fails to check his or her appointment log; or the device is misplaced or in a purse or set down at a location separate from that of the owner. Electronic devices should seemingly be a convenient, fool proof way to schedule appointments; however, in many cases individuals with such devices manage, for one reason or another, to miss appointments.

Figure 4:
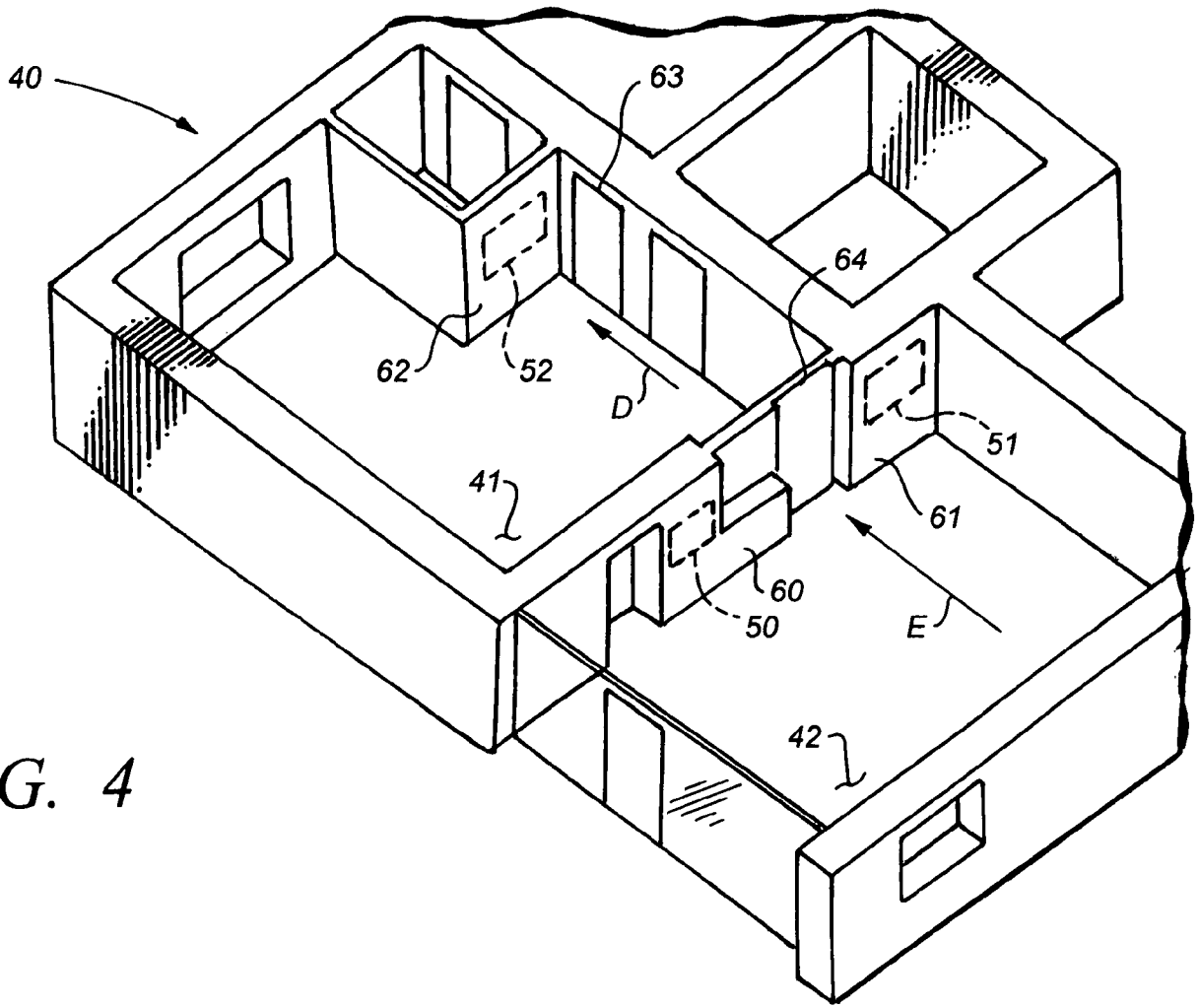
FIG. 4 is a perspective, cut away view illustrating placement of a calendar in a residence in accordance with the invention; and, FIG. 5 is a perspective view further illustrating placement of a calendar in a residence in accordance with the invention.

In FIG. 1, reference character 14 indicates a defined area designating a day of the month of September 2011. The sheet 10 also includes headings 16, 17 indicating days of the week. In FIG. 2, reference characters 24 and 25 each indicate a defined area designating a day of the month of November 2011. The sheet 20 also includes headings 21 and 22 indicating days of the week. Insert 28 for sleeve 26 includes information 29 formed on insert 28. In FIG. 4, structure 40 includes room spaces 41 and 42.

Having described my invention in terms understandable to those of skill in the art, and having described the presently preferred embodiments and best mode thereof, I claim:

1. A method to remind an individual of an event scheduled in advance for the distant future, comprising the steps of (a) providing a calendar including a plurality of discardable removable pliable sheets overlaid in registration with each other, said plurality of sheets (i) each including at least one imprinted sequential month and the days thereof, (ii) collectively including sequential months and the days thereof extending over a period of time comprising at least one year, (ii) each including a plurality of sequential defined areas each designating one day of a month and having a width of at least three inches, a first one of said sheets displaying a current month, and a second one of said sheets located behind said first one of said sheets displaying a future month;

(b) providing a plurality of sleeves each having a width no greater than said width of each of said sequential defined areas;

(c) providing a plurality of attachment structures for securing each of said sleeves to a different one of said sequential defined areas;

(d) manually vertically mounting said calendar in a vertical orientation at eye level on a wall at an increased awareness location in an individual's residence, said increased awareness location (i) being in a high traffic area utilized by the individual at least twice a day, (ii) comprising a vertically oriented mounting surface, and (iii) requiring the individual to walk directly toward said calendar;

(e) scheduling in advance during said current month an appointment in the distant future on an appointment day in said future month;

(f) manually mounting, with one of said attachment structures, one of said sleeves to one of said defined areas in said future month corresponding to said appointment day in said future month;

(g) manually inserting in said one of said sleeves printed information about said appointment;

(h) manually incorporating on said one of said sleeves printed information about said appointment;

(i) walking through said high traffic area and directly toward said wall and said calendar at least twice a day in said residence;

(j) manually periodically removing from said calendar and discarding ones of said sheets which include months preceding said future month and which do not include said future month until (i) the one of said sheets including said future month is visible, and (ii) said one of said sleeves mounted in said one of said defined areas corresponding to said appointment day is visible; and, (k) viewing, when the one of said sheets including said future month is visible, said printed information inserted into and incorporated on said one of said sleeves mounted in said one of said defined areas corresponding to said appointment day.

* * * * *